US008784269B2

(12) United States Patent
Wright

(10) Patent No.: US 8,784,269 B2
(45) Date of Patent: Jul. 22, 2014

(54) EXERCISE DEVICE

(76) Inventor: Ken Wright, La Mesa, CA (US)

( * ) Notice: Subject to any disclaimer, the term of this patent is extended or adjusted under 35 U.S.C. 154(b) by 0 days.

(21) Appl. No.: 12/868,563

(22) Filed: Aug. 25, 2010

(65) Prior Publication Data

US 2011/0207580 A1 Aug. 25, 2011

Related U.S. Application Data

(60) Provisional application No. 61/237,267, filed on Aug. 26, 2009.

(51) Int. Cl.
*A63B 24/00* (2006.01)

(52) U.S. Cl.
USPC ..... 482/4; 482/8; 482/44; 482/45

(58) Field of Classification Search
USPC ..... 482/1–9, 900–902, 44, 45, 148; 434/247
See application file for complete search history.

(56) References Cited

U.S. PATENT DOCUMENTS 3,977,676 A * 8/1976 Geisselbrecht ..... 482/120
4,277,912 A * 7/1981 Hsien ..... 446/233
4,625,961 A * 12/1986 Brand ..... 482/116
5,439,408 A * 8/1995 Wilkinson ..... 446/409
5,542,672 A * 8/1996 Meredith ..... 463/37
5,580,338 A * 12/1996 Scelta et al. ..... 482/62
5,683,284 A * 11/1997 Christen ..... 446/233
6,030,272 A * 2/2000 Hu ..... 446/233
6,458,008 B1 * 10/2002 Hyneman ..... 446/259
6,740,014 B2 * 5/2004 Tsai ..... 482/115
7,686,740 B1 * 3/2010 Chang ..... 482/50
7,942,793 B2 * 5/2011 Mills et al. ..... 482/130
7,955,239 B2 * 6/2011 Wojtkiw et al. ..... 482/129
2003/0060331 A1 * 3/2003 Polk et al. ..... 482/20
2007/0225121 A1 9/2007 Olason et al.
2008/0312052 A1 12/2008 Krietzman
2009/0197499 A1 * 8/2009 Davis ..... 446/57

OTHER PUBLICATIONS

International search report dated Nov. 23, 2010 for corresponding PCT application PCT/US10/46706.

* cited by examiner

*Primary Examiner* — Glenn Richman
(74) *Attorney, Agent, or Firm* — DLA Piper LLP (US)

(57) ABSTRACT

The system provides an exercise device where resistance is provided by one or more of gyroscopic forces, centrifugal forces, magnetic forces, torus forces symmetric field physics, electro-mechanical forces, mass shaping, frequency dynamics, etc. In one embodiment, a handheld device with an internal flywheel is provided. The flywheel is spun up to a desired speed and provides a gyroscopic resistance to movement in a particular direction relative to the orientation of the device. By holding the device in a particular orientation and attempting to move the device against the gyroscopic effect, resistance is provided for exercising. The device itself is relatively light so that the resistance exists principally when the device is being moved. In one embodiment, the rate of rotation of the flywheel can be controlled via an on-board control so that the resistance can be increased or decreased during exercise movement.

5 Claims, 7 Drawing Sheets

EXERCISE DEVICE

This patent application claims priority to U.S. Provisional Patent Application Ser. No. 61/237,267 filed Aug. 26, 2009, which is incorporated by reference herein in its entirety.

BACKGROUND OF THE SYSTEM

Exercise equipment has been fundamentally the same since modern times. Current exercise equipment provides one or both of resistance (i.e. weights, universal gyms, and the like) or positioning (sit up boards, chin up bars, pilates tables, and the like). The resistance is currently provided by physical devices such as weights, rubber bands, springs, step-up gears, friction devices, and the like.

A disadvantage of current exercise equipment is a lack of portability. Any equipment that attempts to provide resistance to the user is difficult to transport or move around by its very nature. A set of weights, for example, are heavy and cumbersome and must be stored in a rack. Because different muscles require different resistance, a range of weights is required for use. This usually requires a dozen or more plates, barbells, dumbbells, etc. This takes up a lot of room in a gym and even more in a home environment. The immovable nature of the weights means that the user must exercise near the weights (typically inside) and prevents the user from perhaps exercising outside or moving freely to other places that could help with variety and motivation.

Similarly, a system that uses springs or rubber bands requires a large device on which to mount them. Such a device is not portable and takes up too much space.

Another disadvantage of current resistance schemes is that once a resistance is selected, the user cannot change the resistance dynamically during exercise. In other words, the user must temporarily stop exercising to increase or decrease the resistance. This prevents optimum results by preventing a user from doing extra repetitions with slightly less resistance.

BRIEF SUMMARY OF THE SYSTEM

The system provides an exercise device where resistance is provided by one or more of gyroscopic forces, centrifugal forces, magnetic forces, torus forces symmetric field physics, electro-mechanical forces, mass shaping, frequency dynamics, and the like. In one embodiment, a handheld device with an internal flywheel is provided. The flywheel is rotated at a desired speed and provides a gyroscopic resistance to movement in a particular direction relative to the orientation of the device. By holding the device in a particular orientation and attempting to move the device against the gyroscopic effect, resistance is provided for exercising. The device itself is relatively light so that the resistance exists principally when the device is being moved. In one embodiment, the rate of rotation of the flywheel can be controlled via an on-board control so that the resistance can be increased or decreased during exercise movement, providing a workout that is impossible using current exercise equipment.

DETAILED DESCRIPTION OF THE SYSTEM

The system provides a device including a flywheel mass that may be caused to move by activation by a user. The system moves a mass in one of a plurality of ways to provide gyroscopic, centrifugal, and/or other forces and thus providing resistance to movement of the device in certain orientations or directions. The system creates a force-field applied by mechanical, electromechanical, magnetic and other actuation methods, moving mass(es) in a number of ways, including, but not limited to, rotating, accelerating and decelerating, osculation, frequency variations, axis turning, direction changing, smooth path geometry, interruptive path geometry, and shape-density-size-proximity of mass in motion. Change in a direction creates forces greater than the mass of the object. The user experiences full 360 degree, three axis motion resistance. The forces are controlled through speed, axis change, and directional change.

Figure 1:
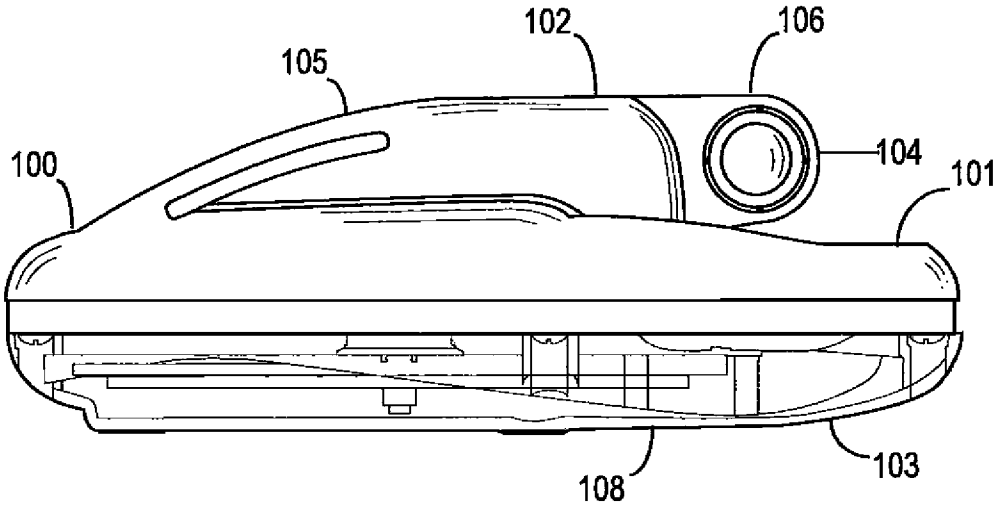
FIG. 1 is a diagram of one embodiment of the system.

One embodiment of the system is illustrated in the side view of FIG. 1. The device 100 has an upper section 101 and lower section 102. The upper section 101 includes an arcuately shaped handle member 102 with a gripping region 104 by which a user will hold the device. Region 104 may be a tube shaped member or some other type of member which may be gripped by a user's fingers. In one embodiment, the region 104 is integrally formed with the handle 102. The device is designed in one embodiment such that the center region 108 of the device is located at the approximate position of the wrist of a user when the user grips the handle for use. The handle 102 includes slots 105 formed therein through which a strap or band may be passed to aid in securing the device 100 to a user's wrist or arm. A power switch 106 may be built into the handgrip so that the user may activate or deactivate the device as desired for operation.

In one embodiment, the lower portion 103 may be translucent or transparent, and may include lights that are activated during use of the device. The device includes a mass that can be moved in response to activation by a user to provide a gyroscopic effect that creates force vectors in a particular relationship with the axis of the system. The gyroscopic force acts as resistance to movement or to a change in orientation of the moving mass. In one embodiment the moving mass is a rotating rotor or flywheel.

Figure 2A:
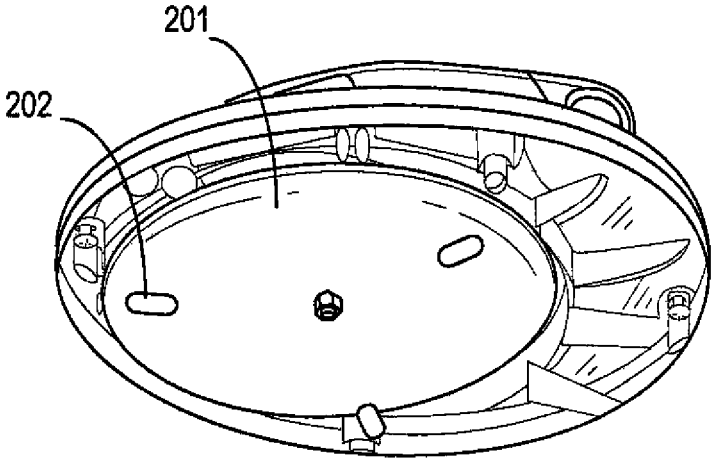
FIGS. 2A and 2B illustrate a bottom perspective view of an embodiment of the device of FIG. 1.
Figure 2B:
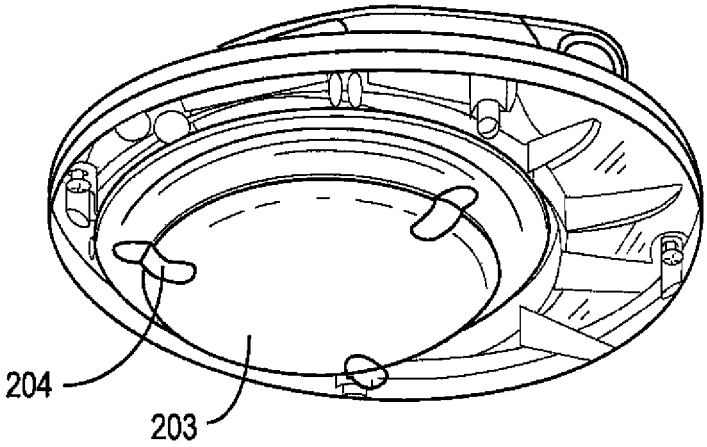

FIGS. 2A and 2B illustrate a bottom perspective view of an embodiment of the device of FIG. 1. The device includes a bottom plate with a plurality of clip locations such as location 202. If desired, the mass of the device can be increased using attachable plates. As seen in FIG. 2B, a plate 203 is attached using clips, such as clip 204 mounted in clip location 202. In this manner, the system has flexibility in providing a plurality of resistances using different size plates. In one embodiment, there are a plurality of different sized plates 203 that can be attached to the device 100. In other embodiments, a plurality of similarly sized (or differently sized) plates of mass can be stackably attached to device 100 so as to selectably increase the mass of the device.

Figure 3:
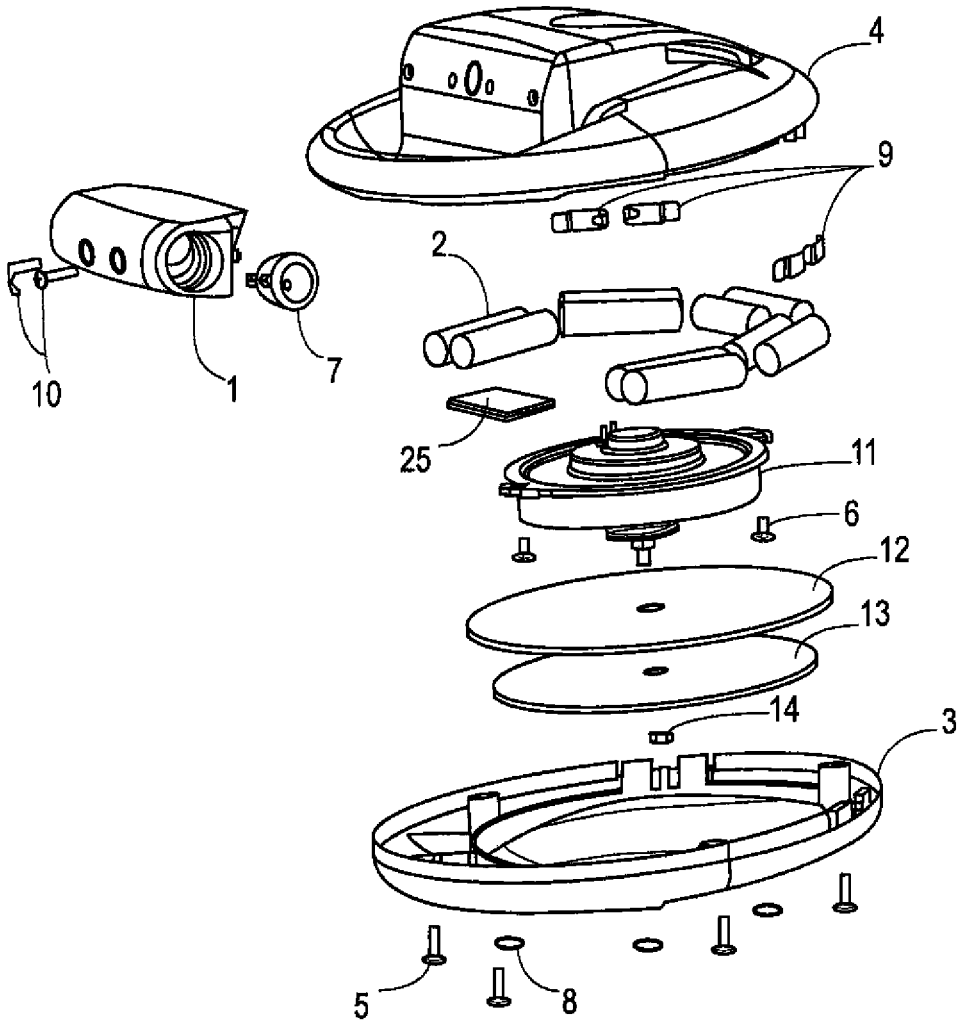
FIG. 3 is an exploded view of one embodiment of the system.

FIG. 3 is an exploded view of one embodiment of the system. The body top 4 includes ramped region with slots formed therein for receiving a restraining strap (not shown). Located within the body of the device and mounted between body top 4 and body bottom 3 are the motor 11, one or more flywheels (such as flywheels 12 and 13), a plurality of batteries 2, contact tabs 9 for providing electrical contact for the batteries, and fastening devices for mounting the interior elements to corresponding locations on the body top 4 and body bottom 3. A processor/memory module 25 is coupled to the motor and to the power source for controlling the operation of the device. Lights may be included in one embodiment such as LED lights of various colors. In addition, a speaker or other audio producing device may be included in the system and coupled to and controlled by the processor/memory 25.

A handle 1 includes an activation switch 7 mounted in a position that is accessible by the thumb of a user. In one embodiment the handle has a "handedness" in that there is a right hand handle and a left hand handle. The right hand handle, such as handle 1 shown in FIG. 3, includes the activation switch 7 on the left side where the user's thumb would be positioned. This allows the user to easily turn the device on and off with a thumb-press as desired. Correspondingly, a left handed handle would have the activation switch on the right side where the left thumb could be used to activate the device.

Although the device is illustrated with cylindrical batteries (e.g. AA or AAA batteries), the system may use any type of battery, including custom shaped, sized, and capacity batteries without departing from the scope and spirit of the present device. Depending on the relative weight between the motor/flywheel assembly and the power supply (e.g. batteries) it may be desired to attempt to evenly distribute the weight of the batteries about the axis or hub of the motor/flywheel assembly to provide balance for the device. In the embodiment shown, the majority of the parts are the same for both right handed and left handed devices, with only the position of the power switch 7 changing as appropriate.

Figure 4:
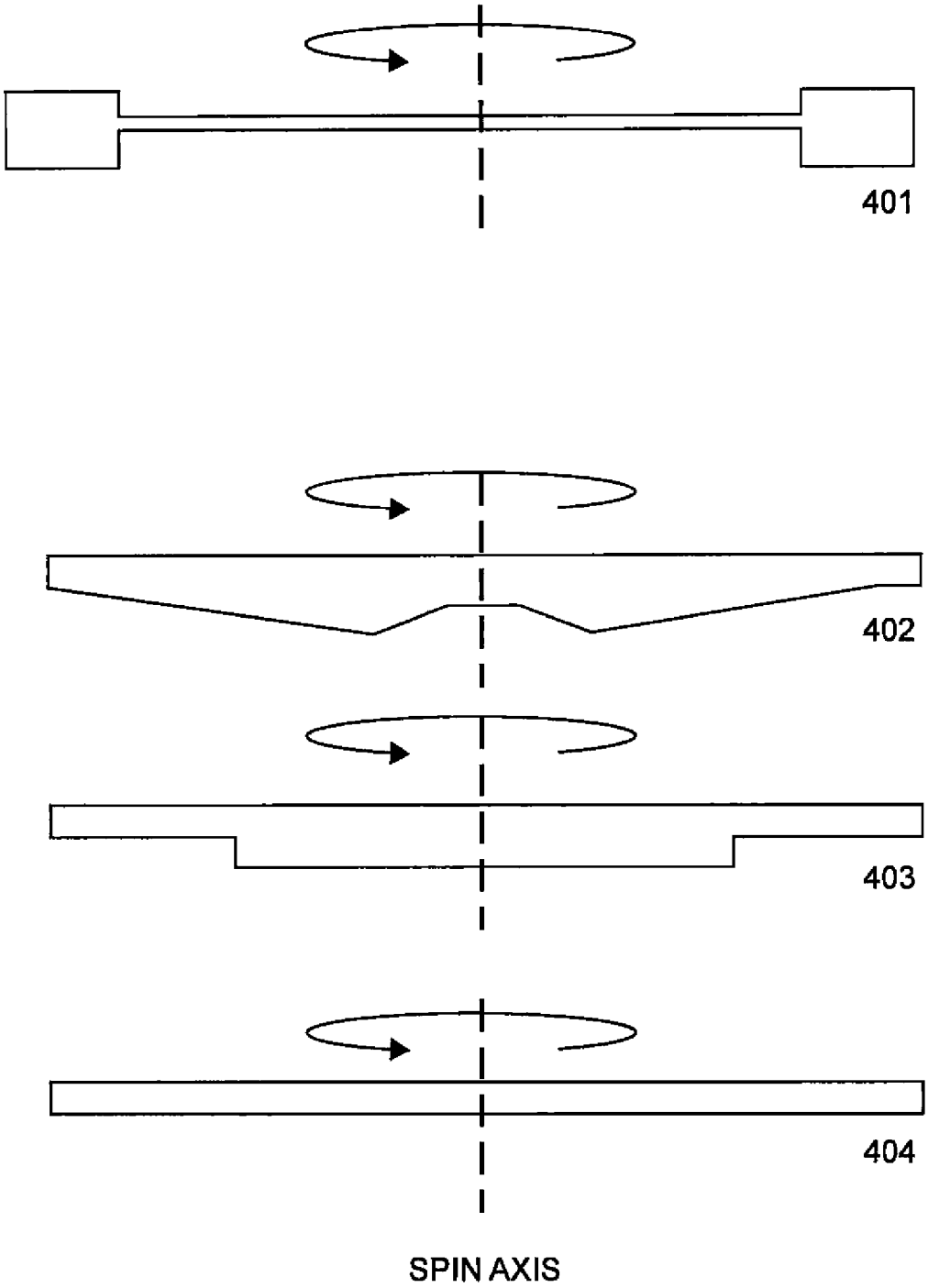
FIG. 4 is an example of flywheel shapes of embodiments of the system.

FIG. 4 is an example of flywheel shapes of embodiments of the system. In one embodiment, the system uses a traditional flywheel shape 401 where the mass is distributed toward the outside circumference. Embodiment 402 uses a conical shaped mass distribution where mass is increased toward the axis of the flywheel in a gradual manner, resulting in a sloped cross section. Embodiment 403 utilizes a stepped shape where the mass is greater for a certain radius of the flywheel and then is less from that radius to the outer radius of the flywheel. Although embodiment 403 shows a single stepped profile, two or more steps can be used in the system. Embodiment 404 shows a flywheel with a consistent mass distribution across the entire radius of the flywheel.

Figure 5:
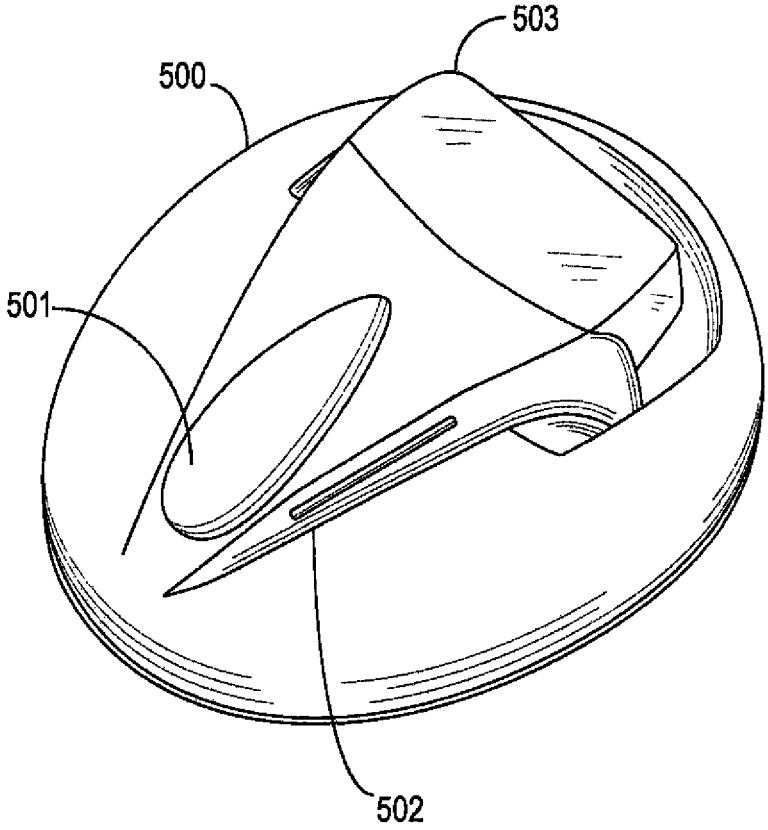
FIG. 5 is a top perspective view of an embodiment of the system.

FIG. 5 is a top perspective view of an embodiment of the device. The upper surface of the device 500 includes a slanted handgrip region 501 that includes a slight depression for receiving the wrist of the user as the user grips the handle 503. As noted above, the device includes a slot 502 formed therein to receive a strap (typically with Velcro fastening means, although any suitable means may be used) for securing the device to the user's wrist or arm. In one embodiment, the finger grip 503 is "handed" such that it may be formed to be more comfortable in the right hand or left, as the case may be, with an activation switch mounted to be accessible by the thumb of the appropriate hand.

Figure 6:
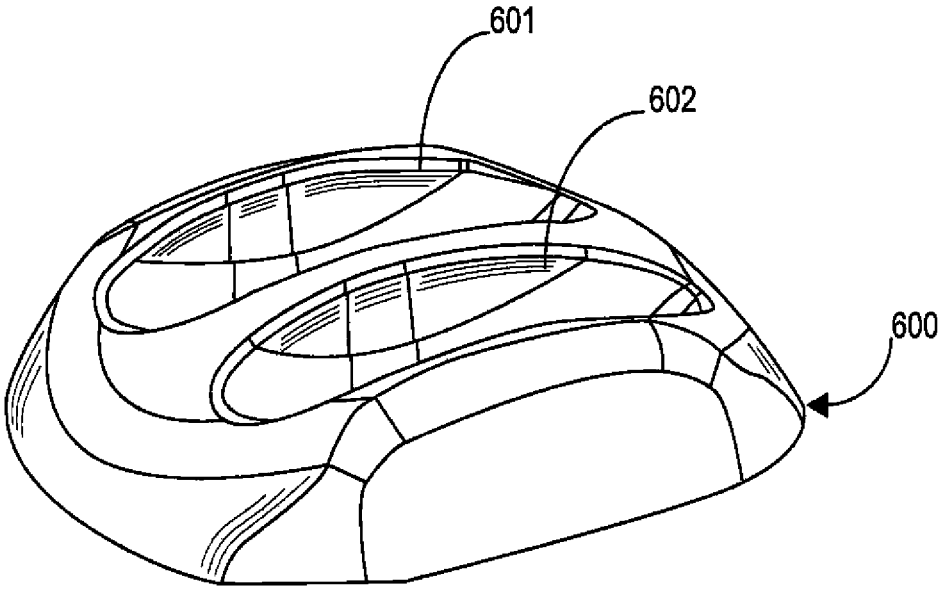
FIG. 6 is a view of a charging station.

FIG. 6 is an example of a charging station of one embodiment of the system. The charging station 600 is coupled to a current source such as a standard household outlet. The station includes two slots 601 and 602 that each include contacts coupled to the power supply. The power may be coupled through an integrated transformer (not shown) to provide the appropriate voltage and current for recharging the power supplies of the hand-held devices. The devices, such as device 100 of FIG. 1, include charging contacts on the rear edge that engage the contacts of the charging station when properly engaged and seated in the charging station. In one embodiment, the rear of a device is seated in one of slots 601 or 602 such that the device is standing up in the charger. Indicator lights are provided either on the charging station or on the device itself for letting the user know the status (charging, charged, on/off) of the charging operation.

Operation

The rotation of the flywheel creates a gyroscopic effect such that attempts to move the device from its plane of rotation results in resistance against the user. The resistance provided is greater than the actual weight of the device. The system has the advantage that the user can hold the device easily when not moving but encounters resistance when moving. This is distinct from current technologies where the resistance is the same whether moving or not. Such prior art systems tire the user more easily, preventing the user from doing the exercise motions enough to get maximum benefit.

With the device, a user can "rest" by stopping motion, while still holding onto the device and staying in the proper exercise position and posture. If the user needs to do, for example, ten repetitions of an exercise motion, the user might be tired after seven or eight reps. In the past, the user would be tempted to set down the resistance and either not do all of the reps, or have a long interruption before picking up the resistance again and finishing the set. Using the device herein, the user can do as many reps as possible, stand with the device in hand and in position, with no need to put it down or remove it, and then resume the motion to finish the number of reps. This provides maximum benefits from the exercise.

In another embodiment, the device has variable speed control activated, for example, via a thumb or finger switch that can be engaged while holding onto the device for exercise. In this manner, the user can electively and dynamically increase or decrease the resistance even during an exercise motion. If the user begins to tire after some number of reps, the user might reduce the resistance so that at least the user can finish the number of reps. Such a change in the prior art is not possible without completely stopping the exercise and changing weights, springs, rubber bands, or friction settings.

In one embodiment, the flywheel is comprised of an appropriate material such as steel or other metal, stone, or perhaps a synthetic material. In one embodiment, the flywheel weighs approximately ½ pound and is approximately 6 inches in diameter. The motor is battery powered and includes a replaceable or rechargeable battery. Once the flywheel is spun up to speed, it takes less power to maintain its rate of rotation, allowing for extended battery life. If desired, braking means can be provided within the device to permit more rapid deceleration of the flywheel to provide quicker transitions between resistances as desired.

In another embodiment, the system uses fluid and eddy currents to provide the resistance and force effect.

In another embodiment, the device 100 includes a processor and memory. In one embodiment, the processor and memory are mounted on the motor 11. The processor can control the speed, timing, and direction of the motion of the flywheel. The memory may contain fixed and/or programmable instructions that provide one or more exercise programs to control the flywheel. For example the rate of rotation of the flywheel can follow a program where the speed is at different rates for different periods of time. This can be in conjunction with a set of instructions to the user to move the device in one or more particular motions in following along with the program. In another program, the device will tend to cause the user's arm or hand to move in a certain direction so that the user will follow along with a pre-programmed routine.

In one embodiment, the device includes weight and orientation shifting means that can be controlled by the processor. By selectively shifting these elements, the device produces a force effect in different directions that guides the user through desired motions.

Figure 7:
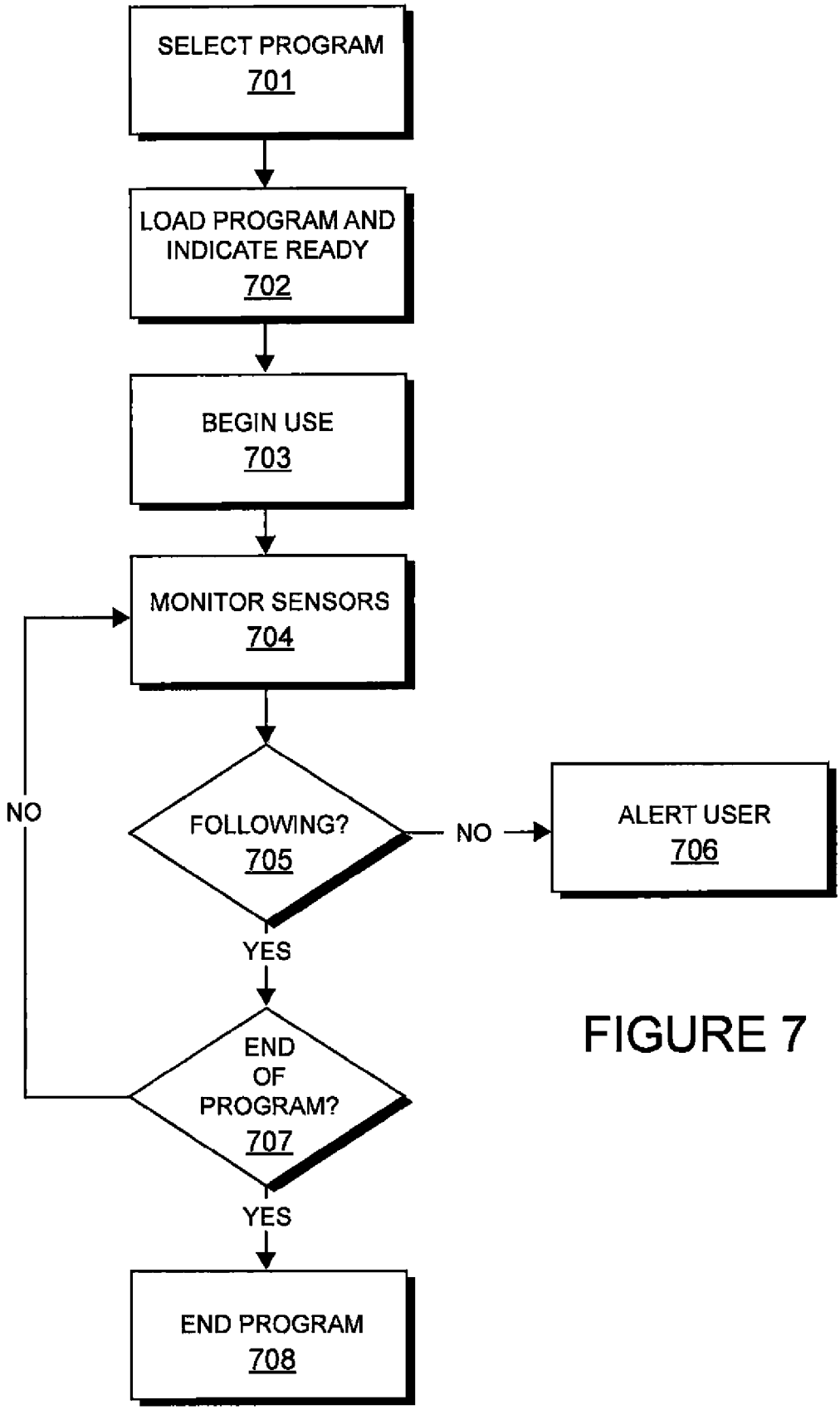
FIG. 7 is a flow diagram of one embodiment of operation of the system.

The device 100 may also include force detectors, accelerometers, or other devices that can detect the movement, direction, and orientation of the device. When coupled to the processor and memory, these systems can determine when a user is following a programmed exercise routine. FIG. 7 is a flow diagram of the operation of the system in a programmed environment in one embodiment of the system. At step 701 the user selects one of the stored exercise programs in the device. This may be via the power switch or via some other selection means coupled to the processor/memory. At step 702 the system loads the program and indicates a ready state via a visual and/or audio cue to the user. This may consist of a pattern of lights flashing on and off, and/or some pattern of beeps. At step 703 the user begins using the device in the programmed routine.

At step 704 the system uses the onboard sensors to monitor motion and effort of the user. At decision block 705 the system determines if the user is following the program. If so, the system proceeds to step 707. If not, the system provides an alert (again, using visual and/or audio cues) at step 706 to let the user know that the program is not being followed.

At step 707 the system checks to see if the programmed routine is finished. If not, the system returns to step 704. If so, the system ends the program at step 708.

In another embodiment, the device may include a wrist strap to make it easier to maintain the device in the hand for more vigorous exercising. This allows the user to use a full range of motion without concern that the device will fall away from the user. In addition, the device may be secured on the feet, calves, thighs, lower or upper arms, or other parts of the body. One or more of the devices may be used simultaneously so that more unique exercises may be performed.

In another embodiment, the device is substantially annular with an outer ring and an optional diameter member traversing the ring. In one embodiment, the motor and power source (e.g. battery) are disposed in the diameter member and used to propel a mass or masses within the annular ring portion. Once in motion, the mass or masses result in gyroscopic and centrifugal forces that provide resistance to movement of the device in certain directions. The user can grip the device with one or both hands using hand grips or at a center grip. The mass may be metal, stone, synthetic or may even be a liquid that is caused to rotate around the annular portion.

In another embodiment, two or more of the devices can be coupled together to permit larger resistances than can be possible with just one device. Another embodiment includes a barbell type device with devices on each end to provide a unique resistance effect in arm based exercises. In another embodiment, one device has the motive means and add-on devices have a means for connecting a hub or spindle to the "parent" device so that additional resistance can be provided. There may be two or more stackable pieces attached to a base system.

Another implementation of the annular device is to use it to provide alignment to a person. The device might be disposed around the midsection of a person (without the diameter member) and activated so that the mass or force is active. If the person starts to lean in one direction, the device will direct force to keep them erect. This can be used alone or in combination with the devices of FIG. 1 or FIG. 2 as part of an exercise system or other use.

The device can provide work out of multiple muscle groups at once with a focus on arms and core to provide amore complete workout in less time. The system activates stabilizer muscles providing a more complete workout while decreasing the chance of injuries. The stabilizer muscles are activated even when other (e.g. primary muscles) are targeted during use. The device and system promotes proprioception (i.e. knowing where your body is in space). By activating stabilizer muscles and requiring control to keep the forces acting on the device in one plane, balance and posture are trained and improved.

What is claimed is:

1. A device comprising:

a handheld housing;

a gyroscopic force creating system mounted within the housing for creating gyroscopic force resistant to movement of the handheld housing in at least one direction, wherein the gyroscopic force is greater than the weight of the device;

a controller coupled to the gyroscopic force creating system for modifying the amount of gyroscopic force; and a processor/memory means coupled to the gyroscopic force creating system for controlling the device pursuant to one of a plurality of programs controlling the amount of force generated by the device and the length of time the force is generated, wherein the device is configured to generate substantially all of the force when the device is being moved and substantially no force when the device is not being moved.

2. The device of claim 1 wherein the force creating system is a rotating flywheel.

3. The device of claim 2 wherein the housing further includes a handle having a power switch located thereon.

4. The device of claim 3 wherein the housing comprises an upper body portion and a lower body portion.

5. The device of claim 4 further including a processor/memory unit coupled to the rotating flywheel.

* * * * *